United States Patent [19]

Rose et al.

[11] Patent Number: 4,907,483

[45] Date of Patent: Mar. 13, 1990

[54] MUSICAL INSTRUMENT SUSTAINERS AND TRANSDUCERS

[76] Inventors: Floyd D. Rose, 5610 145th Ave. SE., Bellevue, Wash. 98006; Steven M. Moore, 14264 SE. 6th St. T-205, Bellevue, Wash. 98007; Richard W. Knotts, 201 Galer #241, Seattle, Wash. 98109

[21] Appl. No.: 199,851

[22] Filed: May 27, 1988

[51] Int. Cl.[4] ..... G10H 3/18; G10H 3/26

[52] U.S. Cl. ..... 84/726; 84/738; 84/740; 84/DIG. 10

[58] Field of Search ..... 84/1.04–1.16, 84/DIG. 10

[56] References Cited

U.S. PATENT DOCUMENTS

| | | | |
|---|---|---|---|
| 3,571,483 | 3/1971 | Davidson | 84/1.16 |
| 3,742,113 | 6/1973 | Cohen . | |
| 3,813,473 | 5/1974 | Terymenko . | |
| 3,983,777 | 10/1976 | Bartolini . | |
| 4,075,921 | 2/1978 | Heet . | |
| 4,137,811 | 2/1979 | Kakehashi . | |
| 4,151,368 | 4/1979 | Fricke et al. | 84/DIG. 10 |
| 4,151,776 | 5/1979 | Stich . | |
| 4,181,058 | 1/1980 | Suenaga . | |
| 4,236,433 | 12/1980 | Holland . | |
| 4,245,540 | 1/1981 | Groupp . | |
| 4,364,295 | 12/1982 | Stich . | |
| 4,484,508 | 11/1984 | Nourney | 84/1.05 |
| 4,535,668 | 8/1985 | Schaller . | |
| 4,580,481 | 4/1986 | Schaller et al. . | |
| 4,697,491 | 10/1987 | Maloney . | |

*Primary Examiner*—Stanley J. Witkowski

*Attorney, Agent, or Firm*—Lerner, David, Littenberg, Krumholz & Mentlik

[57] ABSTRACT

A sustainer for providing sustained sounds from a musical instrument has a feedback circuit for converting a pickup signal representing a vibration of a string or other vibratory element to a drive signal and applying drive forces to the vibratory element responsive to the drive signal. The sustainer is arranged to compensate for the phase lag of the pickup signal relative to motion of the vibratory element and to compensate for the phase lag of the drive forces provided by the driver relative to the drive signal. The feedback circuit may be arranged to provide a phase difference between the drive signal and the pickup signal such that the phase difference varies with frequency towards a drive signal leading phase difference with increasing frequency. This phase compensation provides enhanced response of the strings in the fundamental mode of vibration. The driver preferably is arranged so that the drive forces applied to the strings do not vary with lateral movement of the strings.

36 Claims, 6 Drawing Sheets

MUSICAL INSTRUMENT SUSTAINERS AND TRANSDUCERS

The present invention relates to a device for providing a sustained sound from a musical instrument having a vibratory element such as a string.

BACKGROUND OF THE INVENTION

Musical instruments employing a vibrating mechanical element such as a string to produce sound have been provide heretofore with transducers commonly referred to as "pickups" for detecting the motion of the vibrating element and producing an electronic signal representing this vibration. This pickup signal may be amplified and converted to sound by a loudspeaker. The sound produced from the pickup signal supplements or replaces the sound produced by acoustical interaction of the string, the instrument body and the air. Typically, the instrument body has little or no acoustic response, so that the sound produced from the pickup signal constitutes essentially the entire sound of the instrument. This is the case in the common electric guitar, electric bass and the like.

The sound produced by instruments of this nature dies out progressively after the string is excited. This is particularly so in the case of instruments having little or no independent acoustic response. The sound can be prolonged somewhat by operating the amplification and loudspeaker system at extremely high power levels so that strong acoustic waves representing the original vibration impinge upon the string. Such "acoustic feedback" tends to sustain the vibration of the string, thereby prolonging the note. However, this approach is effective only when the sound produced by the amplification an loudspeaker system is extraordinarily loud. Moreover, the acoustic feedback effect depends upon the acoustic properties of the environment. Therefore, this effect will produce different results in different concert halls Various attempts have been made to provide a "sustainer" or device capable of prolonging the notes independently of acoustic feedback from the environment U.S. Pat. No. 4,245,540 discloses a sustainer incorporating a loudspeaker mounted in close proximity to the strings. The amplified signal from the pickup is passed to the loudspeaker, so that acoustic vibrations produced by this loudspeaker will impinge directly upon the strings. U.S. Pat. No. 4,697,491 discloses a sustainer for a tringed instrument such as a guitar having a body and a neck projecting from the body. An electromechanical transducer is mounted to the neck, remote from the body. The pickup signal is passed to this electromechanical transducer. The transducer vibrates the neck and these vibrations are fed back into the strings. U.S. Pat. No. 3,813,473 discloses an instrument having a "bridge" or string support linked to an electromagnet. An electronic signal derived from the pickup signal is applied to this electromagnet, so as to vibrate the bridge and, hence vibrate the strings. U.S. Pat. No. 4,484,508 describes a generally similar sustainer having an electromechanical transducer adapted to shake the instrument body responsive to the pickup signal, and also having a circuit for progressively reducing the amplitude of the signal so as to provide a controlled fadeout. The fadeout circuit is arranged to provide a quicker fadeout for higher frequency signals.

U.S. Pat. Nos. 4,137,811 and 4,181,058 provide a sustain action utilizing magnetic interaction between a static magnetic field and electrical currents passing through the strings themselves. Thus, a magnet is mounted adjacent the strings, and both the strings and frets of the instrument are electrically conductive. Circuitry is provided for directing an alternating current feedback signal representing the pickup signal through the strings via the frets. The alternating current in each string interacts with the static magnetic field to produce an alternating magneto-motive drive force on the string. U.S. Pat. No. 4,236,433 discloses a sustainer employing an electromagnetically actuated tensioning device for each string, each such tensioning device being connected to a feedback circuit. The signal from a pickup associated with each string is applied through the feedback circuit to the tensioning device, so that the tensioning device will periodically stretch and release the string. The '433 patent also discloses an alternative arrangement wherein an electromagnet or "driver" is juxtaposed with each string so that flux from the electromagnet will impinge directly upon the string. Each such electromagnet is provided with a drive signal representing the signal from a pickup associated with the same string. Thus, variations in magnetic flux of the electromagnet will cause variations in the flux impinging upon the strings. This varying flux tends to excited the string in vibration, provided the string itself is ferromagnetic. U.S. Pat. No. 4,075,921 discloses a generally similar approach, employing a magnetic pickup and a magnetic driver arranged to directly excite a ferromagnetic string. The sustainer may be a hand held, battery-powered device incorporating both a pickup and a driver, and arranged so that the pickup and driver can be aligned with one string of the instrument. Alternately, the sustainer may be built into the instrument and may be provided with separate pickups and drivers for the various strings. U.S. Pat. No. 3,742,113 likewise employs a magnetic pickup and magnetic driver directly associated with each string, with a feedback and amplification circuit connected between the pickup and the driver. The '113 patent emphasizes that the feedback circuit or amplifier should have "zero phase shift" so as to provide a driving force "in phase with the string's fundamental frequency of oscillation as transduced by the pickup" so as to reinforce the fundamental mode vibration of the string.

The aforementioned '921, '433 and '113 patents utilize pickups and drivers having a separate ferromagnetic pole piece disposed beneath each string, so as to provide a substantially concentrated magnetic field from each pole piece at normal, undistorted position of the associated string. Separate coils may be provided for each pole piece. U.S. Pat. Nos. 4,580,481 and 4,535,668 disclose a pickup having a unitary, oblong coil and ferromagnetic core extending laterally across the string array. Movable permanent magnets are also provided. By repositioning the permanent magnets, the field direction can be varied s as to provide different phase relationships among the signals induced in the coil by the various strings. U.S. Pat. No. 3,983,777 suggests a pickup having a uniform magnetic field strength across the lateral extent of the string array to suppress variations in pickup response caused by lateral movement of the strings. Other unitary pickups having a single coil and a single ferromagnetic pole piece extending across the string array are shown in U.S. Pat. Nos. 4,364,295 and 4,151,776.

Despite the extensive efforts of the art heretofore, there have been substantial, unmet needs for further improvement. The sustainers available heretofore generally have been inefficient, in that they require substantial electrical power to the drive coil in order to produce an appreciable sustain effect. This high power consumption poses a significant problem where the sustainer draws its power from a battery mounted on the instrument.

Moreover, application of high power to an electromagnetic drive coil in a sustainer tends to produce substantial electromagnetic emissions. Electromagnetic fields radiated rom the drive coils impinge upon the pickup and induce unwanted signals. Although the pickups used in electronic musical instruments typically incorporate features for suppressing the effect of stray electromagnetic radiation, these measures are not always perfectly effective. Radiation from the driver can be suppressed to some degree by shielding, but such shielding adds weight, bulk and cost. Thus, there has been a substantial need heretofore for an efficient sustainer capable of providing a powerful sustaining effect with only a modest power input to the driver. There has been a further need for a sustainer which would permit the musician to adjust the action of the sustainer to provide varied artistic effects.

SUMMARY OF THE INVENTION

The present invention addresses these needs.

A sustainer according to one aspect of the present invention is adapted for use with a musical instrument having at least one vibratory element, which may be a string or the like. The sustainer includes drive means for applying a drive force to a vibratory element of the instrument responsive to the drive signal so that the drive force bears a predetermined phase relationship to the drive signal. Feedback means are provided for accepting a pickup signal representing vibration of the vibratory element of the instrument and having a predetermined phase relationship to the vibration. The feedback means are arranged to provide a drive signal to the drive means such that the drive force applied by the drive means will be substantially in phase with the vibration of the vibratory element. The sustainer may further include a pickup for providing the pickup signal in response to the vibration of the string.

One or both of the pickup means and the drive means typically will have a non-zero phase shift. That is, the pickup signal produced by the pickup means may lag or lead the actual movement of the vibratory element, whereas the drive force applied by the drive means may lag or lead the drive signal. The feedback means preferably is arranged to provide a phase shift which is substantially inverse to the combined phase shift of the pickup means and the drive means, taken together. Thus, the combined overall phase shift of the entire sustainer will be approximately zero and the drive force will be applied i phase with the vibratory motion of the string itself, i.e., in phase with the sustainers according to this aspect of the invention can provide a powerful, sustaining action to prolong the fundamental mode vibration of a string or other vibratory element with only modest power input to the driver. Such sustainers according to the invention can provide sustaining action suitable for prolonged, continuous use, as in a concert environment, while employing only small, self-contained batteries as a power supply. Although the present invention is not limited by any theory of operation, it is believed that the enhanced results achieved arise at least in part from better phase matching of the force applied to the vibratory element and the actual, fundamental mode vibration of the vibratory element.

The feedback means may be arranged so that for at least some frequencies of the pickup signal, the drive signal differs in phase from the pickup signal and this phase difference varies with frequency. Most desirably, such variation in the phase difference between the pickup and drive signals is towards a drive signal leading phase difference with increasing frequency. Preferably, the feedback means is operative to provide the drive signal so that for at least some frequencies, the drive signal leads the pickup signal.

Control means may be provided for determining the frequency content of the pickup signal and altering the phase transfer function of the feedback means, the phase transfer function of the drive means or both depending upon this frequency content. Thus, the control means may include means for adjusting the phase transfer function of the feedback means towards a drive signal leading condition as the predominant or highest amplitude frequency of the pickup signal increases.

The drive means may include an inductive coil and means for applying he drive force to the vibratory element responsive to magnetic flux produced by the coil. The force applied by drive means employing an inductive coil tends to lag behind the drive signal or voltage applied to the coil. Moreover, this lag increases with the frequency of the signal. Thus, the phase difference and variation in phase difference with frequency provided by the feedback means according to this aspect of the present invention come for the characteristics of the drive means. Where the pickup signal provided by typical electromagnetic pickups tends to lag behind the actual motion of the vibratory element or string, and where this lag likewise increases with frequency the phase difference and the variation in phase difference with frequency provided in the feedback means of the preferred sustainers are believed to compensate for the characteristics of the pickup as well. The net result is to provide a drive force substantially in phase with the fundamental motion of the vibratory element.

The feedback means most preferably includes a network having an input for receiving a pickup signal, an output for delivering the drive signal and a variable value component connected between the input and output. The network may be arranged so that adjustment of the variable valuable component alters the phase transfer function of the network, i.e., the relationship between phase shift through the network and frequency. The control means may include means for monitoring the frequency of the pickup signal and adjusting the value of the variable value component response to the frequency of the pickup signal so as to alter the phase transfer function of the network. The pickup signal is typically a complex signal, incorporating components at various frequencies. Desirably, the means for monitoring the frequency of the pickup signal is arranged to detect the predominant frequency in the pickup signal, having the greatest amplitude, and to provide a signal representing this predominant frequency. The means for adjusting the value of the variable value component desirably includes means for adjusting this value dependent upon the signal representing the predominant frequency. This arrangement provides a selective sustain effect, in that the sustainer is adjusted to provide the optimum phase transfer function for the reinforcement of particular frequencies having the greatest amplitude.

A further aspect of the present invention provides a sustainer for a musical instrument of the type having a plurality of taut, flexible strings extending in a lengthwise direction and disposed side-by-side in an array. The sustainer according to this aspect of the invention includes means for providing a drive signal and drive means for applying drive forces to the strings responsive to the drive signal so that the drive force applied to each string is substantially independent of lateral displacement of the string. Therefore, the response of the sustainer is substantially unaffected by lateral bending of the strings.

Preferably, the drive means includes means for providing a magnetic field varying in accordance with the drive signal so that the varying magnetic field is substantially uniform throughout the range of lateral motion of each string. The means for providing a varying magnetic field may include a ferromagnetic element, means such as a coil juxtaposed with this element for directing magnetic flux through the ferromagnetic element and means for mounting the ferromagnetic element so that it extends laterally across the string array. The surface of the ferromagnetic element facing toward the strings may be substantially parallel to an imaginary surface defined by the strings when in their normal, undistorted position. The ferromagnetic element employed in this arrangement preferably includes a permanent magnet.

In an alternate arrangement, the coil encircles the strings. A pair of ferromagnetic elements such as permanent magnets may be spaced apart from one another in the lengthwise direction of the strings and disposed above and below the string array, with the coil encircling the strings between these elements.

These and other objects, features and advantages of the present invention will be more readily understood from the detailed description of the preferred embodiment set forth below, taken in conjunction with the accompanying drawings.

DETAILED DESCRIPTION OF THE PREFERRED EMBODIMENTS

Figure 2:
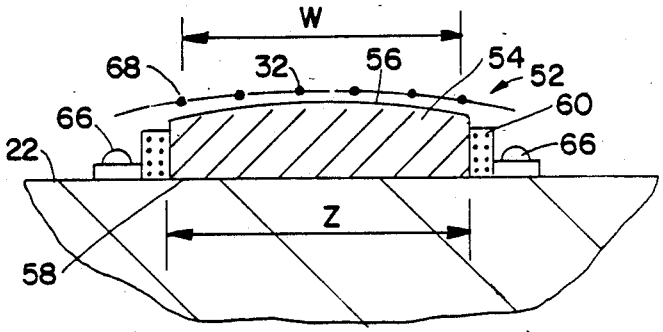
FIGS. 2 and 3 are fragmentary, schematic sectional views taken along lines 2—2 and 3—3 respectively in FIG. 1.

A conventional electric guitar 20 has a structure including a body 22 and an elongated neck 24 projecting from the body. A conventional tailstock 26 and bridge 28 are secured to body 22, whereas a headstock 30 is secured to the end of neck 24 remote from head 22. Frets 25 are arranged along neck 24. Six ferromagnetic, typically steel strings 32 are held under tension by tailstock 26 and headstock 30, and engaged with bridge 28 so that each string extends generally in the same, longitudinal direction from the tailstock to the headstock, the strings being disposed side-by-side above the neck 24 and body 22. The strings thus define an array having a widthwise direction transverse to the longitudinal direction and generally parallel to the top or string-facing surfaces of the neck and body. As used in this disclosure the terms "widthwise" and "laterally" should be understood as referring to this widthwise direction of the string. Also, the terms "up" and "down" should be understood as referring to the directions from the strings away from and towards the surface of the guitar body, respectively. As seen in FIG. 2, the directions to the left and to the right are widthwise or lateral directions, whereas the directions towards and away from the top of the figure are upward and downward, respectively.

Guitar 20 incorporates a pickup 34 of the type known in the art as a "hum-bucking" pickup mounted to body 22 adjacent bridge 28. Pickup 34 incorporates a permanent magnet 36 extending along the top surface of body 22, magnet 36 having its north-seeking pole facing rearwardly, towards headstock 30 and its south-seeking pole facing forwardly, towards tailstock 26. The pickup also includes six ferromagnetic prongs or projections 38 adjacent the north-seeking pole of magnet 36 and six similar prongs or projections 40 adjacent the south-seeking pole. These projections 38 and 40 are disposed in pairs. Each such pair includes one projection 38 adjacent the north-seeking pole and one projection 40 adjacent the south-seeking pole. Both projections of each pair are aligned with one string 32. The projections tend to concentrate the flux from the magnet on the strings.

Figure 3:
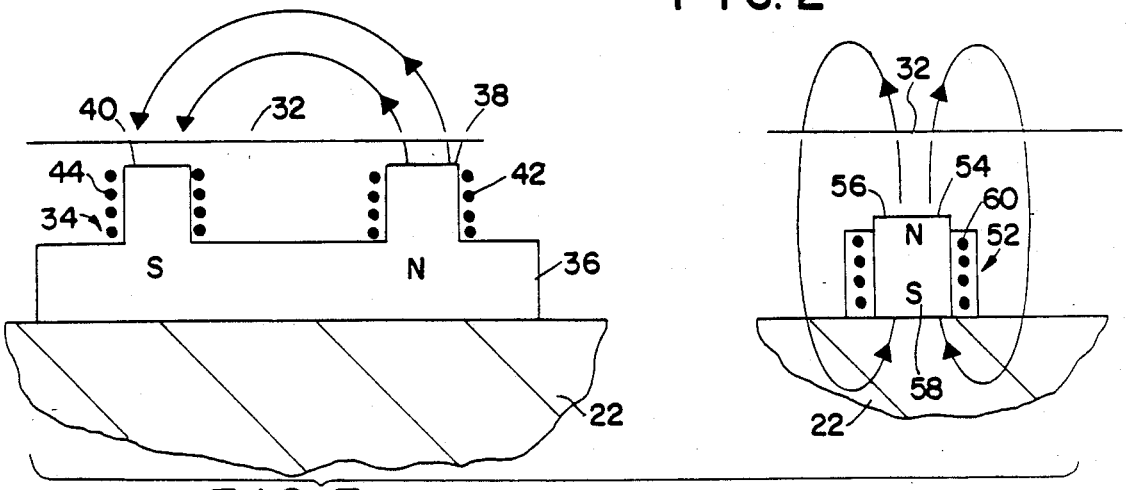

As illustrated in FIG. 3, considering the generally accepted convention for magnetic flux direction, the flux emanates from each projection 38 upwardly through the aligned string 32 and returns, in the downward direction again through the string to the associated projection 40. A coil 42 wound in a first predetermined direction extends around all of the projections 38, whereas a coil 44 wound in the opposite direction extends around all of the projections 40. Coil 42 is in series with coil 44. Upward and downward motion of a string 32 associated with a particular pair of projections 38 and 40 will change the distance between the string and the projections 38 and 40 and hence will alter the magnetic reluctance between the projections. As the string approaches the projections (downward movement) the reluctance will decrease so that there will be an increase n upwardly directed flux through the projection 38 and an increase in downwardly directed flux through projection 40. The opposite will occur for upwardly directed movement of the string. For any particular upward or downward string movement, the voltages induced by the oppositely directed changes in flux in the oppositely wound coils will reinforce one another, and hence will produce an appreciable output voltage. As all of the strings cause similar flux changes the output of pickup 34 will be a composite signal representing the upward and downward motions of all of strings 32. Stray electromagnetic signals will induce oppositely directed voltages in coils 42 and 44. Thus, stray electromagnetic fields produce little or no output signal.

The output or pickup signal may be sent to a conventional amplifier 46 and loudspeaker 48 (FIG. 4), desirably via a conventional free space communications link 50 such as a radio frequency link or the like. Preferably, the free space communication link and pickup are arranged to operate without any wired connection to either a fixed power supply or to the amplifier 46. Thus, those portions of the free space communication link 50 mounted to guitar 20 may be powered by a battery likewise mounted to the guitar. Pickup 34 desirably is connected to free space communications system 50 via the preamplifier 74 of the sustainer, further discussed hereinbelow.

The sustainer includes a driver 52. Driver 52 incorporates an elongated generally rectangular ferromagnetic element 54 (FIG. 3). Element 54 is a permanent magnet composed of a ceramic ferromagnetic material such as the material commonly available in the magnet trade under the designation "Ceramic-B". The magnetization of element 54 is directed so that the north-seeking pole of the element extends along one relatively long, narrow face 56 of the element and the south-seeking pole extends along the opposite face 58. Driver 52 also includes a drive coil 60 encircling element 54. Coil 60 is generally helical, the shape of the helix being distorted to fit closely around element 54. The axis of helical coil 60 extends in the pole to pole direction of element 54, i.e., between faces 56 and 58. Drive coil 60 has a ground connection 62, an end connection 64 opposite from the ground connection, and a center tap 66.

Appropriate means such as screws 66 or other conventional securement devices are provided for mounting driver 52 to the structure of instrument 20 at a preselected drive location along the longitudinal extent of strings 32. The drive location is preferably remote from bridge 28 and from headstock 30, and may be approximately midway between the bridge and the headstock. Thus, the drive location may be adjacent the juncture between body 22 and neck 24. The mounting means are arranged to secure driver 52 to the instrument structure so that the long dimension Z (FIG. 2) of element 54 extends in the lateral direction of the string array, and so that the north-seeking pole face 56 of element 54 faces upwardly towards the array of strings 32. As the long dimension Z of ferromagnetic element 54 is greater than the lateral extent W of the string array 32, the ferromagnetic element protrudes laterally beyond both edges of the string array.

With driver 52 is secured to the body, magnetic flux resulting from the permanent magnetism of element 54 impinges on strings 32. As best seen in FIG. 3, the permanent flux from ferromagnetic element 54 is generally co-directional with the flux in each rearward projection 38 on pickup 34. The flux in element 54 and in each projection 38 is upwardly directed. Stated another way, the flux in the driver ferromagnetic element is co-directional with the flux in the closest active portion or projection of the pickup. As best seen with reference to FIG. 2, the upwardly facing, north-seeking pole face 56 of ferromagnetic element 54 extends substantially parallel to an imaginary surface 68 defined by strings 32 at the driver location. Thus, the upper or string-facing surface 56 of element 54 has a slight upward bow adjacent its midpoint. This slight curvature matches the curvature of the imaginary surface 68 defined by strings 32 at the drive location, also visible in FIG. 2. Thus, the distance between the string facing surface 56 and the imaginary surface 68 defined by the strings is substantially constant across the entire lateral extent of the string array. Surface 56 of the ferromagnetic element is substantially devoid of appreciable projections extending towards the strings or notches extending away from the strings, at least within the lateral extent of the string array, and preferably beyond this extent as well. Thus, the permanent magnetic flux from element 54 impinging on strings 32 is substantially uniform across the entire width of the string array, and this uniform flux extends laterally beyond the string array.

As stings 32 are ferromagnetic, the flux from element 54 produces a constant attractive force on the strings. Magnetic flux generated by coil 60 will either oppose or reinforce the flux due to the permanent magnetism of element 54, depending upon the direction of current flow in the windings of coil 60. Thus, the attractive force applied by the driver to the strings will decrease or increase upon the amount and direction of current flow in coil 60. Ferromagnetic element 54 tends to distribute the flux from coil 60 uniformly over the lateral extent of the string array and slightly beyond the string array as well. Thus, by applying an alternating voltage across coils 60, an alternating current can be induced in the coil so as to alternately increase and decrease the attractive force applied to strings 32 by driver 54. Stated another way, an alternating drive signal applied to coil 60 will produce an alternating driving force on the string. This alternating force, either attractive or repulsive, will be superposed on the constant attractive force exerted by the permanent magnetism of element 54. Inasmuch as flux from coil 60 will be substantially uniformly distributed, the driving force on each string will be substantially uniform despite lateral displacement of the string.

The sustainer also incorporates feedback means 70 (FIG. 4) for accepting the signal from pickup 34 and applying a drive signal to driver 52 responsive to the pickup signal. Feedback means 70 includes input connection 72 for receipt of the pickup signal. Input 72 may be provided as a plug or tap adapted to be connected to the pickup 34. Input 72 is connected to a preamplifier 74. The output of preamplifier 74 is connected to the input of free space communications system 50, so that the pickup signal passes from pickup 34 to the communications system 50 via the preamplifier. The preamplifier has a high input impedance. It serves to isolate pickup 34 from loading by the communications system.

The output of preamplifier 774 is also connected to a pickup signal input node 76. Input node 76 is connected by straight through connection circuit 78 to one terminal **84*a* of a three-position selector switch 84. Input node 76 is also connected t a lag circuit 80 and to variable lead circuit 82, which in turn are connected to terminals 84*b* and 84*c* of switch 84, respectively. The common terminal 84*d* of switch 84 is connected through an automatic gain control circuit 145, a booster amplifier 146 and on/off switch 86 to an output amplifier 88**.

Figure 4:
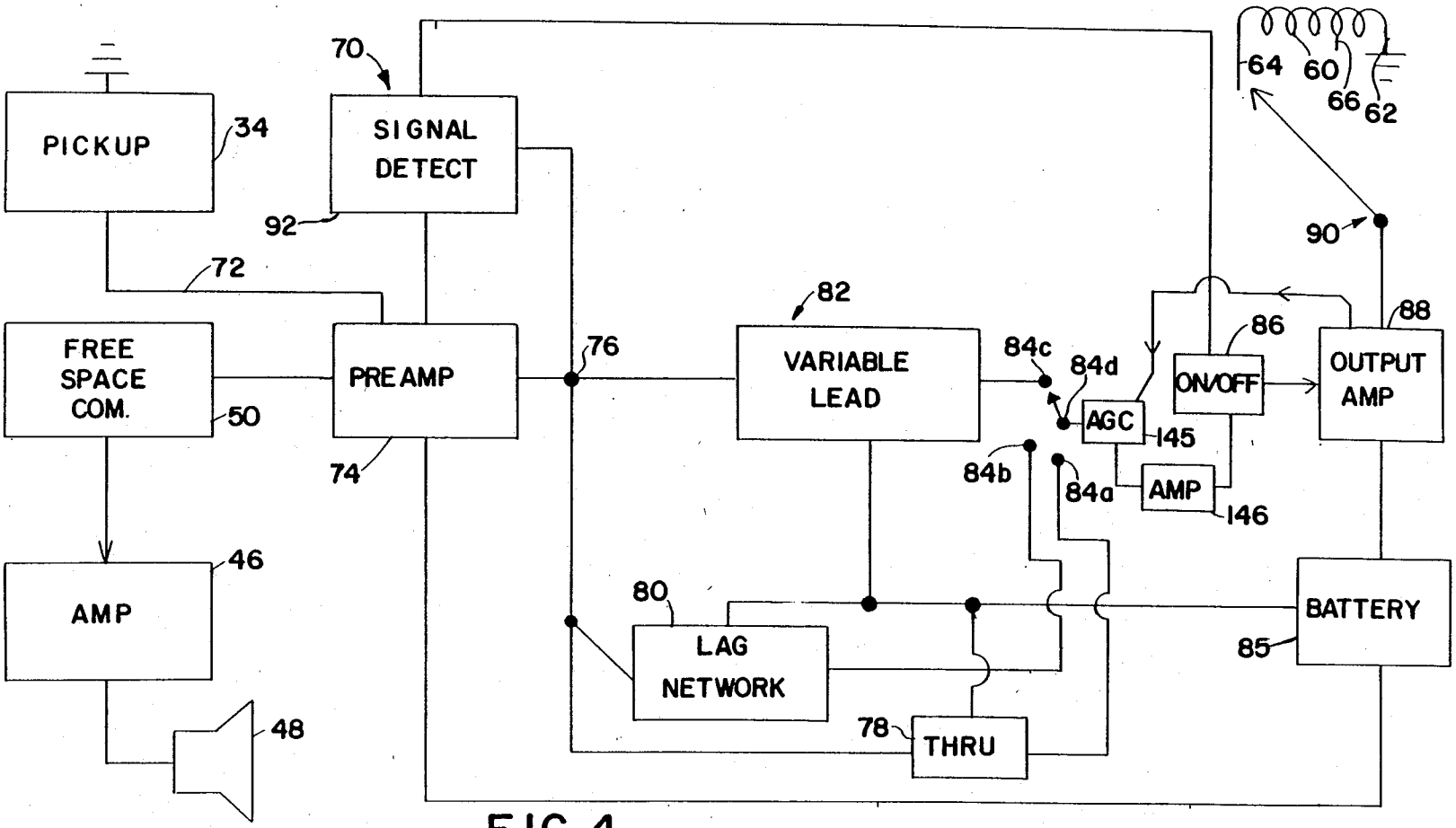
FIG. 4 is a functional block diagram of the sustainer and instrument shown in FIG. 1.

Automatic gain control circuit 145 includes a capacitor 131 (FIG. 5), resistor 133 and field effect transistor 135 in series, in the signal path. The gate of FET 135 is connected to the wiper or variable tap of a potentiometer 137. Potentiometer 137 is connected in parallel with a capacitor 139, between ground and a diode 141. Diode 141 in turn is connected via resistor 143 to the output of output amplifier 88 (FIG. 4). The resistence of FET 135, and hence the level of the signal delivered to booster amplifier 146 is controlled by the setting of potentiometer 137 and by the voltage across capacitor 139. This voltage in turn depends upon the signal level delivered by output amplifier 88. Booster amplifier 146 is a conventional operational amplifier arrangement. On/off switch 86 may be a conventional metal oxide semiconductor field effect transistor or "MOSFET", having a control input or gate connection, a signal input and a signal output. Unless a voltage applied to the control input exceeds a predetermined threshold, the device is substantially non-conducting between the signal input and signal output. Output amplifier 88 may be a conventional push-pull transistor amplifier.

Output amplifier 88 in turn is connected to the input of a two position switch 90, this switch being operative to connect the output amplifier to either end connection 64 or center tap 66 of drive coil 60. A signal detector 92 is connected to the output of preamplifier 74 at node 76. Signal detector 92 may be a conventional device for producing a voltage representative of the amplitude of the signals from preamplifier 74. Thus, the signal detector 92 may incorporate an amplifier, a rectifier connected to the output of the amplifier and a capacitor connected to the output of the rectifier with a appropriate bleed connection from the capacitor so that the voltage accumulated on the capacitor will represent the time-averaged rectified output of the amplifier. The voltage from signal detector 92 is applied to the control input of on/off switch 86.

Preamplifier 74, ACC circuit 145, booster amplifier 146, on-off switch 86 and output amplifier 88 introduce substantially zero total phase shift for signals in the audio range. Straight through circuit 78 likewise introduces substantially zero phase shift. Thus, when the preamplifier is connected to the output amplifier through straight-through circuit 78, the drive signal or voltage provided by output amplifier 88 is substantially in phase with the pickup signal applied to preamplifier 74 For any signal within the audio frequency range positive-going excursions of the drive signal occur substantially simultaneously with positive-going excursions of the pickup signal. In this regard, it should be noted that values of the pickup and drive signals specified herein as positive or negative are specified with reference to a consistent sign convention referring to the associated force or motion. Unless otherwise specified herein, a positive pickup signal is a pickup signal associated with upward movement of a string or strings, whereas a negative pickup signal is associated with downward movement of the string or strings. Likewise, a positive drive signal is a drive signal which will produce an upward force (or a lessening of a downward force) on a string or strings, whereas a negative drive signal will produce a downward force (or a lessening of an upward force) on a string or strings. As will be appreciated, the relationship between the sign of the pickup or drive voltage with respect to electrical ground may be the same or different than the sign of such a voltage according to the consistent sign convention used in this disclosure, depending upon the direction of winding of the coils in the pickup or driver and the physical orientation of those coils. Thus, a zero phase shift according to the consistent sign convention used herein may imply either 0° or 180° shift according to conventional considerations of polarity with respect to ground.

Lag network or circuit 80 has a single, predetermined phase transfer function or relationship between incoming signals applied at node 76 and outgoing signals transmitted to switch terminal **84*b* through network 80. Lag network 80 may include an input node 100 (FIG. 5) connected to node 76, an output node 102 connected to switch terminal 84*b*, and an operational amplifier 104 having inverting and non-inverting inputs and having an output connected to output node 102 of the lag network. The lag network may further include resistors 106 and 108 connected between input node 100 and the inverting and noninverting inputs of amplifier 104, respectively, a feedback resistor 110 connected between output node 102 and the inverting input of amplifier 104 and a capacitor 112 connected between the non-inverting input of amplifier 104 and ground. The phase transfer function of network 80** may be represented by the equation:

$$\text{theta}_{80} = 2 \arctan (2\ \text{pi}/R_{108}C_{112})$$

Where:

$\text{theta}_{80}$ is the amount by which the output signal at node 102 lags the input signal at node 100;

$R_{108}$ is the value of resistor 108;

$C_{112}$ is the value of capacitor 112; and f is the frequency of the signal.

Variable lead circuit 82 includes an attenuator 120 having an input connected to mode 76. The gain of attenuator 120 has a magnitude less than 1, typically about 0.4. The output of attenuator 120 is connected to the pickup signal infeed node 126 of a variable phase transfer function network 128. Network 128 includes an operational amplifier 130 having an inverting input connected to pickup signal infeed node 126 via a resistor 132. The output of the operational amplifier 130 is connected to a signal outfeed node 134, and a feedback resistor 136 is connected between outfeed node 13 and the inverting input of amplifier 130. A capacitor 138 has a first side connected to pickup signal infeed node 126 and a second side connected to the non-inverting input of amplifier 130. A composite, variable value resistive element 140 is connected between the second side of capacitor 138 and ground. Variable value resistive element 140 includes a fixed resistor 142 and field effect transistor or "FET" 144, the source and drain of FET 144 being connected in parallel with fixed value resistor 142. The signal outfeed node 134 of network 128 is connected to terminal **84*c* of switch 84**.

The gate of FET 144 is connected to frequency monitoring and control circuitry including input waveform squarer 150, frequency to voltage conversion circuit 152 and curve shaping circuit 154. Waveform squarer 150 includes a comparator 156 having a non-inverting input connected to switch node 76 and hence to the incoming pickup signal. The inverting input of comparator 156 is connected between resistors 159 and 160, which in turn are connected between a positive voltage source 165 and ground so as to provide a reference voltage. The output of comparator 156 is connected to a squared waveform output node 162 which is also connected through a reverse connected zener diode 166 to ground. The voltage appearing at node 162 will be substantially a square waveform having only two discrete values. The square waveform will have a first one of these values when the pickup signal component applied through resistor 158 exceeds the reference voltage applied to node 161, and the square waveform at node 162 will have the other one of these values when the reverse condition occurs. Thus, the waveform appearing at node 162 will represent the pickup signal converted to a square waveform. The frequency of the square waveform will be controlled by the components of the pickup signal having the greatest amplitude. In a pickup signal produced by free vibrations of a single string, the frequency of the square waveform at node 162 will be substantially equal to the fundamental frequency of vibration of that string.

Figure 5:
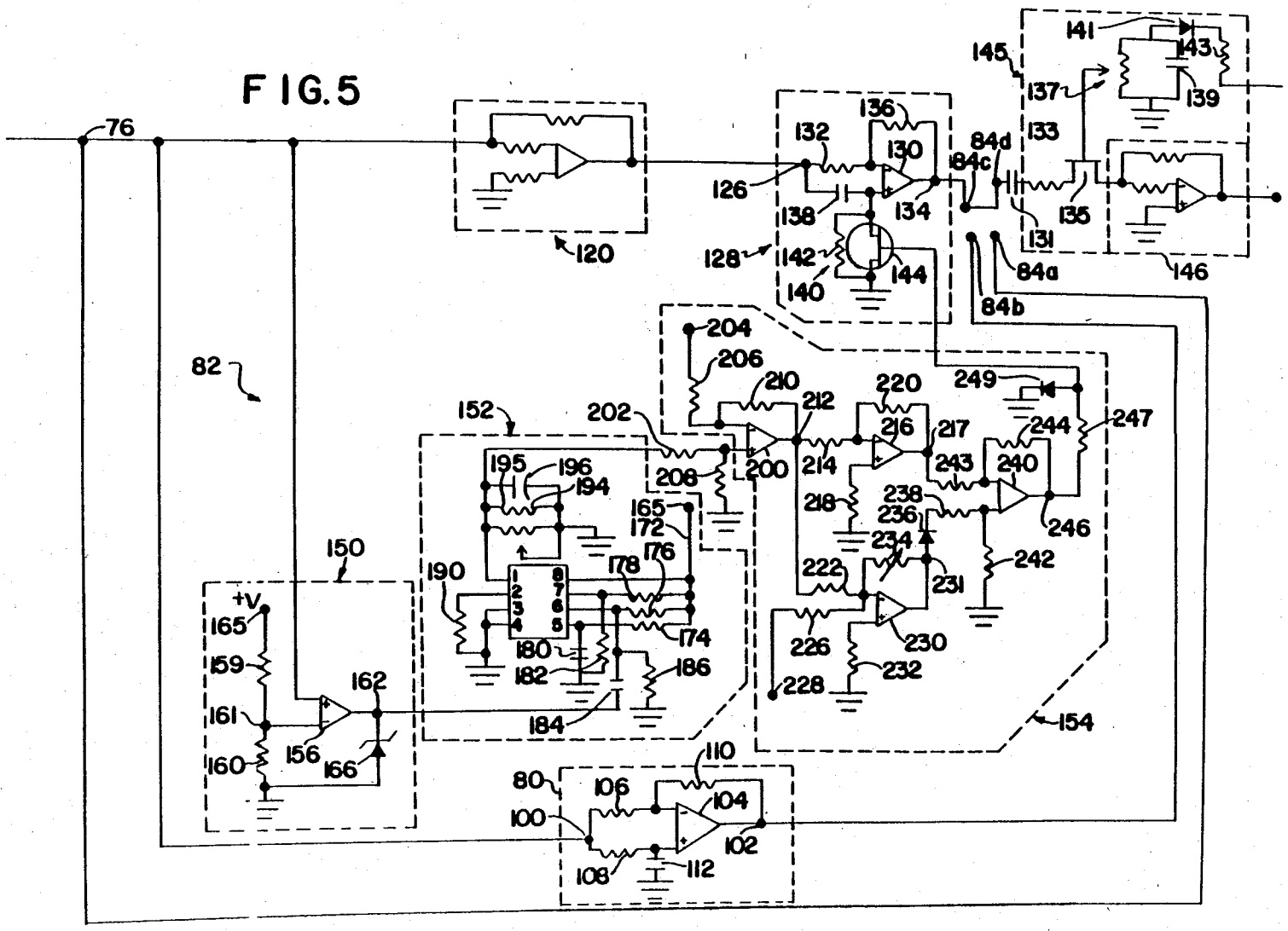
FIG. 5 is a schematic circuit diagram showing a portion of the sustainer of FIGS. 1–4.

Frequency to voltage conversion circuit 115 includes a microcircuit 170 is arranged to detect the frequency of the square waveform at node 162 and to produce an output voltage which is approximately a linear function of this frequency, such voltage being zero when the frequency is zero. Microcircuit 170 may be a circuit of the type sold as Part No. XR4151 by the EXAR company of Sunnyvale, Calif. For this particular microcircuit, the connections for each pin are as illustrated in FIG. 5 utilizing the manufacturer's pin designations. Pin 4 is connected directly to ground, whereas pin 2 is connected to ground through resistor 190. Pin 3 is not connected. Pin 1 serves as the output connection of microcircuit 170. A potentiometer 194, fixed resistor 195 and capacitor 196 are connected between pin 1 and ground. Pin 8 is connected directly to a positive voltage bus 172 which in turn is connected to a positive voltage source 165. Pins 5, 6 and 7 are connected through dropping resistors 14, 176 and 178 to the same bus. Pin 5 is also connected through capacitor 180 to ground, whereas pin 7 is further connected to ground through resistor 182. The output node 162 of squarer 150 is connected through capacitor 184 to pin 6, there being a dropping resistor 186 connected between pin 6 and ground.

Curve-shaping circuit 174 includes an operational amplifier 200 having a non-inverting input connected to the output of frequency to voltage converter 152 via resistor 202 and an inverting input connected to an adjustable positive voltage source 204 via resistor 206. A grounding resistor 208 is connected between the non-inverting input of operational amplifier 200 and ground, whereas a feedback resistor 210 is connected between the output node 212 of the operational amplifier and the inverting input. In effect, operational amplifier 200 and the associated resistors serve to subtract the reference voltage provided by source 204 from the voltage output by frequency to voltage converter 152 and then multiply the difference by a fixed gain, with the product of this multiplication appearing at output node 212.

Node 212 is connected via resistor 214 to the inverting input of operational amplifier 216. The non-inverting input of this operational amplifier is connected via resistor 218 to ground, and a feedback resistor 220 is connected between the inverting input and the output node 217 of operational amplifier 216.

Node 212 is also connected to resistor 222, which in turn is connected at node 224 to a further resistor 226 and through resistor 226 to an adjustable reference voltage source 228. Node 224 is connected to the inverting input of a further operational amplifier 30. The non-inverting input of amplifier 230 is connected via resistor 232 to ground. An adjustable feedback resistor 234 is provided between the output node 231 of amplifier 230 and node 224. Node 231 is connected through diode 236 and resistor 238 to ne input of yet another operational amplifier 240. The same input of amplifier 240 is connected to ground via resistor 242. The opposite, inverting input of amplifier 240 is connected via a further resistor 243 to the output node 217 of amplifier 216. A feedback resistor 244 is provided between the inverting input and the output 246 of amplifier 240. The output node 246 of amplifier 240 is connected via resistor 247 to the gate of FET 144 in the variable resistive element 140 of network 128. A diode 249 is connected between resistor 247 and ground.

All of the electrical components of the sustainer, including output amplifier 88, preamplifier 74 and the electrically active components of variable lead and lag circuits 82 and 80 are powered by a self-contained power supply means such as battery unit 85 (FIG. 4). The battery unit and all components of the feedback means are arranged for mounting to the instrument. Thus, as illustrated schematically in FIG. 1 all of the electrical components in the feedback means, including battery unit 85 may be mounted within a housing 87, and housing 87 may be releasably secured to the body 22 of the guitar 20 by an appropriate clamp or other mounting device 89. Alternately, the feedback means and the power supply means or battery unit 85 may be mounted entirely within the body 22 of the guitar. Because the entire sustainer is powered only by the self-contained power supply unit or battery 85, no external power supply connection is required. Battery unit 85 may incorporate a conventional clip for mounting two conventional cells of the type commonly referred to as nine volt transistor radio batteries. Battery unit 85 preferably also incorporates a voltage regulation circuit (not shown) such as a conventional switching regulator circuit to maintain a substantially constant output voltage despite changes in the voltage supplied by the battery. Regulation of the voltage permits use of a battery even during the terminal portion of the battery's life, when the battery voltage begins to decline.

In operation, pickup 34 provides a pickup signal representing vibration of one or more strings 32 to input connection 72, and this signal is amplified at preamplifier 74. With switch 84 set to the position indicated in FIGS. 4 and 5, the preamplified pickup signal is directed through variable lead circuit 82. Squarer 150 detects the pickup signal and provides at output node 162 a square wave having a frequency equal to the predominant frequency in the pickup signal, i.e., the frequency in the pickup signal having the greatest amplitude. As shown schematically in FIG. 6, the voltage $v_{152}$ provided by frequency to voltage conversion circuit 152 is substantially zero when the frequency $f_{162}$ of the square wave appearing at node 162 is zero and increases linearly with increasing frequency of the square wave. The voltage $v_{212}$ appearing at node 212 is a negative voltage with a large magnitude for zero frequency, The magnitude of negative voltage $V_{212}$ decreases linearly as the frequency increases so that $V_{212}$ becomes zero when $f_{162}$ reaches a predetermined maximum value $f_{max}$. This value $f_{max}$ preferably corresponds to the maximum fundamental frequency of the instrument. Thus, for a typical guitar $f_{max}$ may be about 1318 Hz. The voltage $v_{217}$ at node 217 is essentially the inverse of $v_{212}$, i.e., positive for a zero value of $f_{162}$ and decreasing progressively as the frequency $f_{162}$ increases. The voltage $v_{231}$ produced at node 231 responsive to $v_{212}$ is positive when frequency $f_{162}$ is zero, decreases linearly so a to cross zero when the square wave frequency $f_{162}$ is equal to a relatively low changeover frequency $f_c$, and then becomes negative at higher values of $f_{162}$. For a guitar, $f_c$ preferably is about 250–350 Hz and more desirably about 300 Hz. The voltage $v_{246}$ produced appearing at node 246, and hence the gate voltage applied to FET 144, is a composite function of both $v_{231}$ and $v_{217}$. When $v_{231}$ is negative (at square wave frequencies above $f_c$) diode 236 effectively blocks $v_{231}$. Thus, in this frequency range, $v_{246}$ is a function of $v_{217}$ alone, and $$V_{240}=G_{240}(-V_{217})$$

where $G_{240}$ is the gain of operational amplifier 240.

Where $v_{231}$ is positive, at frequencies below $f_c$, diode 236 does not block $v_{231}$ and hence:

$$V_{246}=G_{240}(V_{231}-V_{217})$$

Figure 6:
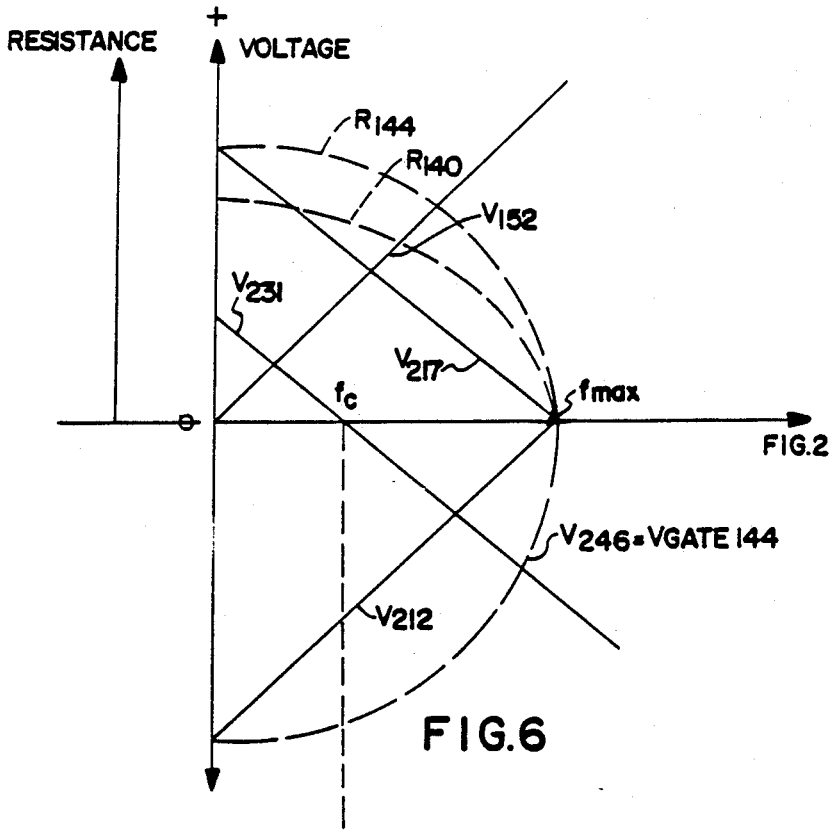
FIG. 6 is a graph of certain variables associated the sustainer of FIGS. 1–5.

Thus, as indicated in FIG. 6, $V_{246}$, the voltage applied to the gate of FET 144, is negative and has substantial magnitude for zero square wave frequency. The magnitude of $V_{246}$ decreases relatively slowly towards zero as the square wave frequency $f_{162}$ increases from zero to $f_c$ and then decreases more rapidly as the square wave frequency $f_{162}$ increases above $f_c$. The source to drain resistance $R_{144}$ of FET 144 is a function of the gate voltage $v_{246}$. As shown in FIG. 6, $R_{144}$ varies over a wide range depending upon $v_{246}$. For strongly negative values of $v_{246}$, at low square wave frequencies, $r_{144}$ may be several hundred kilohms, whereas $R_{144}$ may be only a few kilohms when $v_{246}$ approaches zero, i.e., at square wave frequencies $f_{162}$ approaching $f_{max}$. The overall resistance $R_{140}$ of parallel resistive element 140 likewise declines as $f_{162}$ increases. Inasmuch as the square wave frequency $f_{162}$ corresponds to the predominant or highest amplitude frequency in the pickup signal as supplied to circuit 82, the resistance $R_{140}$ of resistive element 140 is a function of the predominant frequency in the pickup signal and declines as that predominant frequency increases.

The phase transfer function or phase relationship between the signal applied between the infeed node 126 of network 128 and the signal appearing at the outfeed node 134 is given by the following relationship:

$$\text{Theta}_{128}=180^\circ-2\arctan(2\text{pi}fR_{140}C_{138})$$

where:

$\text{Theta}_{128}$ is the amount by which a component of frequency f in the output signal at node 134 leads the corresponding component in the input signal at node 126;

f is frequency;

$R_{140}$ is the resistance of composite element 140; and $C_{138}$ is the capacitance of capacitor 138.

As will be appreciated from inspection of this relationship, for any given fixed value of $R_{140}$ and $C_{138}$, the phase transfer function of network 128 is a predetermined relationship between phase lead and frequency, with the phase lead of the output signal versus the input signal declining as frequency increases. However, the phase transfer function can be adjusted by adjusting the value of $R_{140}$. Because the value of $R_{140}$ is itself a function of the predominant frequency in the incoming, preamplified pickup signal, the above-noted phase transfer function changes in response to the predominant frequency of the pickup signal. As the predominant frequency of the pickup signal increases, and $R_{140}$ decreases, the phase transfer function of network 128 changes so as to provide generally greater output lead for every component of the signal. No single curve relates the lead for a particular frequency component to the frequency of that component. Rather, the lead imparted by network 128 to any component of the signal passing therethrough is a function both of the frequency of the particular component in question and the frequency of the predominant component in the pickup signal at the time in question. However, considering only the predominant frequency component in the signal, these combined effects cause the lead of the predominant component imparted by network 128 to increase with the frequency of that component. In the phase transfer function equation:

$$\text{Theta}_{128}=180^\circ-2\arctan(2\text{pi}fR_{140}C_{138})$$

$R_{140}$ decreases faster than f increases. Where the pickup signal represents the movement of a vibrating string, the predominant or highest amplitude frequency typically is the fundamental vibration frequency. Thus, the lead imparted by network 128 to the fundamental frequency increases as the fundamental frequency component increases. As preamplifier 74 and output amplifier 88 do not contribute any phase shift the drive signal applied by output amplifier 88 to coil 60 leads the pickup signal from pickup 34 (FIG. 4), and this lead is simply the variable lead imparted by circuit 82, i.e., the lead imparted by network 128. Thus, the drive signal applied by output amplifier 88 leads the pickup signal, and the amount of lead in the fundamental frequency component increases with the fundamental frequency.

The drive signal or voltage applied by output amplifier 88 to coil 60 causes current flow in coil 60 and hence produces drive forces on strings 32. The drive forces vary according to the current in coil 60 and this current lags the voltage applied by output amplifier 88. Thus, the drive forces lag behind the drive signal. Moreover, the pickup signal produced by pickup 34 may also lag behind the motion of the strings 32. These lags are related to the frequency of the vibration and the frequency of the signal, and increase with frequency. The increasing lead provided by variable lead circuit 82 compensates for these lags, so that the drive forces applied by driver 52 responsive to pickup signal 34 are substantially in phase with the fundamental vibrations of one of strings 32. Stated another way, the combined phase transfer function of the pickup and driver tends to make the drive force lag behind the motion of the strings and to make this lag increase with frequency. The phase transfer function of the variable lead network is substantially inverse to the combined phase transfer function of the pickup and driver.

Where only one string is initially excited, the predominant frequency in the pickup signal will be the fundamental frequency of that string. Variable lead circuit 82 will adjust its lead characteristics according to that fundamental frequency, and hence will provide the drive force at that fundamental frequency substantially in phase with the vibrations of that string. Where a plurality of strings are excited, the variable lead circuit 82 tends to adjust its lead characteristics according to the fundamental frequency of the particular string having the greatest vibration amplitude. Thus, the variable lead circuit will select lead characteristics which provide the drive force at the optimum phasing for maximum effect in sustaining the vibrations in that predominant string. Because the lead applied by circuit 82 is optimized for only one string, it will be sub-optimal of the other strings. Driver 52 will apply the drive forces to all of strings 2. Although the present invention is not limited by any theory of operation, it is believed that because the drive forces at the fundamental frequency of one string are substantially in phase with the fundamental vibration of that string, and the drive force at the fundamental frequencies of other strings are out of phase with the fundamental vibrations of the other strings, the drive forces will reinforce the vibratory motion of one string to a far greater extent than the others. In any event, when variable lead circuit 82 is in operation and a plurality of strings are initially excited, the sustainer tends to selectively reinforce the vibrations of the one string which initially has the greatest amplitude.

The relationship between lead of the predominant frequency and predominant frequency imparted by variable lead circuit 82 will depend upon the characteristics of the components in the system including the frequency/voltage relationship of frequency to voltage converter 152 and the characteristic of the curve-shaping circuit 154. The relationship can be adjusted by varying any of these parameters. For example, the resistors which determine the various gains and reference voltages applied in curve-shaping circuit 154 can be varied so as to alter the action of the curve-shaping circuit. The optimum relationship will depend upon the phase characteristic of the pickup signal fed to the sustainer. Thus, the optimum phase relationship for the variable lead circuit will depend in part upon whether the pickup signal is a signal which lags behind the motion of the string, the degree of lag and the nature of the change in such lag with frequency. Also, the optimum phase relationship for the variable lead circuit will depend upon the phase transfer function of the driver.

Desirably, one or more of the adjustable components in curve shaping circuit 154 are accessible for manual adjustment during use of the sustainer, so that the characteristic relationship can be "tuned" to an optimum for a particular instrument. For a typical electric guitar tuned in normal fashion the variable lead circuit may be arranged to provide lead of the predominant frequency in the drive signal relative to the pickup signal which increases at the rate of about 35° per octave. Where the predominant frequency is about 100 Hz or less, the lead may be about 0°, i.e., between about −10° (10° lag) and +10° (10° lead). The variable lead network may provide about 130° to about 150° lead of the drive signal predominant frequency relative to the pickup signal for a predominant frequency of about 1318 Hz, the maximum fundamental frequency of the instrument.

Lag network 80 and straight through connection 78 constitute an alternate signal means for providing drive signals having phase characteristics different from the phase characteristics of the drive signal provided by variable lead circuit 82. Thus, the musician can select the effect produced by the sustainer by manipulating switch 84. When the fixed phase transfer function lag network 80 is activated by switch 84, the drive signal lags the pickup signal, and the drive force lags behind the string motion. In this mode, the sustainer tends to reinforce certain harmonics rather than fundamentals. With straight through circuit 78 engaged, the drive signal is in phase with the pickup signal, and hence the drive force lags behind the string motion by an amount equal to the lag caused by pickup 34 and driver 52. In this mode of operation the efficiency of the sustainer in reinforcing the fundamental vibration of the strings is less than with variable lead network 82 engaged. However, this effect is most pronounced at relatively high fundamental frequencies, above about 300 Hz and particularly above 600 Hz. Thus, the sustainer will provide a useful stain action for relatively low frequency fundamentals when straight through circuit 78 is engaged. Moreover, when the straight through circuit is engaged, the sustainer does not tend to lock in on the frequency of only one string. The straight through circuit may be used instead of variable lead circuit 82 while playing chords composed of relatively low-fundamental frequency notes.

The magnitude of the drive signal applied to the drive means, and hence the magnitude of the drive force applied to the strings, can be adjusted by adjusting automatic gain control circuit 145. FET 135 provides an impedence in the path transversed by a feedback signal passing from input 72 to output amplifier 88. FET 135 thus attenuates the signal. The resistance of FET 135, and hence the degree of attenuation, depends upon the voltage applied to the FET gate through potentiometer 137. For any given setting of potentiometer 137, there is a predetermined relationship between the magnitude of the drive signal and this gate voltage such that the degree of attenuation increases as the magnitude of the drive signal increases. Thus, the system tends to stabalize at a predetermined drive signal level. This level can be changed by adjusting potentiometer 137, so as to alter the relationship between attenuation and drive signal magnitude.

Switch 90 may be used to provide a further, coerse control of the power level in the drive signal. With the switch in the position depicted in FIG. 4, and with the drive signal connected to the end tap 64 of coil 60, the full resistance and inductive reactance of the coil are connected across the output of amplifier 88. Therefore, the current through coil 60 and hence the power dissipation of the unit will be relatively low. With switch 90 in an alternate position, with end tap 64 disconnected and center tap 66 connected, the effective inductive reactance and resistance of the coil are reduced and hence the power dissipation in the coil are increased. This provides drive forces of greater magnitude, and hence provides a more potent sustain effect. Thus, by manipulating switch 90 the musician may select either a normal sustain with low power consumption and prolonged battery life or a high power sustain effect with a somewhat shorter battery life. Switch 90 and center top 66 may be omitted where adjustable AGC circuit 145 is provided.

In the conventional fashion, the musician can alter the active length of each sting 32, and hence alter the fundamental frequency of each string by forcing each string against one of the frets 25 on the neck 24. This provides only stepwise adjustment of the fundamental frequency of each string. The musician can further adjust the fundamental frequency of each string by deliberately exerting laterally directed forces on the strings so as to bend the string laterally, in the widthwise direction of the string array. The ends of the strings are constrained against lateral motion by bridge 28 and headstock 30. Because pickup 34 is adjacent bridge 28, lateral movement of the strings at the pickup is minimal, and hence each string remains aligned with the associated projection 38 and 40 even when the string is bent to the maximum possible extent. However, because driver 52 is disposed at a drive location remote from both the bridge and the headstock, the portion of each string overlying the driver can move laterally through a substantial range during play. The range of lateral motion of each string to either side of its normal, undistorted position at the location of driver 52 is about equal to the lateral distance between strings in the array, and may be as much as about one inch to either side of the normal position of the strings. The range of motion of the strings at the edges of the array extends only towards the center of the array, because these outermost strings are not displaced outwardly during normal play.

Lateral movement of the strings does not impair the performance of the sustainer. Because flux from coil 60 is distributed continuously across the widthwise or lateral extent of the string array, each string will be exposed to substantially the same drive forces at any lateral position within its range of lateral motion. Thus, the drive forces applied to each string will be substantially independent of lateral movement of the string. This provides a significant advantage in that the musician is free to achieve the unique effects imparted by deliberate lateral bending of the strings in conjunction with an effective sustain effect. The other components of the sustainer which provide the unique phase transfer function characteristics mentioned above also contribute to this advantage. With these characteristics, useful reinforcement of the fundamental vibration of the string can be achieved with only moderate levels of magnetic flux from coil 60. Thus, there is no need for projections on ferromagnetic element 54 or other devices to concentrate flux from coil 60 at the normal, undistorted position of each string. Such flux concentration devices enhance the action of the sustainer as long as the strings are not bent laterally but materially impair the response if the strings are bent laterally.

The orientation of the permanent magnetic field associated with the driver also affects the action of the sustainer. In the embodiment discussed above, the magnetic flux of the permanent magnetic field associated with the driver is co-directional with the magnetic flux from the most closely adjacent portion of the pickup. This tends to provide stronger reinforcement of the fundamental vibration of the string than the reverse case, where the permanent magnetic flux is counter-directional to the flux from the closest portion of the pickup. The reasons for this difference are not fully understood. Thus, although the reverse case, counter-directional flux arrangement can be employed, it is less preferred. Also, if the reverse case arrangement is employed, the characteristic curve of variable lead network 82 should be modified so as to provide a lag of the drive signal relative to the pickup signal at low frequencies and a lead at high frequencies. The optimum variable lead circuit characteristic for the reverse case is substantially the same as the optimum characteristic curve for the embodiment discussed above, but with the entire characteristic curve displaced towards lag of the drive signal relative to the pickup signal. Even in this case, however, the variable lead network, and hence the feedback means as a whole with the variable lead circuit engaged, will provide a phase transfer function which shifts towards the direction of increasing drive signal lead as the predominant frequency in the pickup signal increases.

The embodiment discussed above can be modified in many ways. For example, the variable resistive element 140 in variable phase transfer network may incorporate a photoresistive element such as a phototransistor instead of field effect transistor 144. In this arrangement, the signal from frequency to voltage conversion circuit 150 may be passed to a light emitting element such as a diode justaposed with the photoresistive element. An appropriate curve-shaping circuit can be interposed between the frequency to voltage convertor and the light emitting diode so that the amount of light produced by the diode, and hence the resistance of the photoresistive element vary as required to provide the desired relationship of phase lead to predominant frequency. Also, the variable element in the variable phase transfer function network 128 may be the capacitor 138 rather than the resistive element. Thus, composite resistive element 140 may be replaced by a fixed value resistor, and capacitor 138 may be replaced by a single capacitive element having capacitance varying in accordance with the signal from the frequency to voltage conversion circuit. Alternatively, capacitor 138 can be replaced by a network of fixed-value capacitors and associated switching elements to selectively connect or disconnect these elements responsive to a signal representing the frequency composition of the pickup signal, such as a signal representing the predominant frequency in the pickup signal. The same result could be achieved by constructing the variable lead network with a variable inductive element.

The variable phase transfer function network 128 used in variable lead circuit 82 can be replaced by a plurality of network branches, each having a different phase transfer function. A switching device may be arranged to select one of the network branches and to direct the pickup signal through the selected branch depending upon the frequency composition of the pickup signal. Such a switching device may be responsive to a signal as employed in the preferred embodiment representing the predominant frequency in the pickup signal, so as to switch branches and thus vary the transfer function of the network as a whole stepwise as the predominant frequency increases or decreases. In yet another arrangement, the switching device may be omitted and may be replaced by frequency-selective filters arranged so that various components of the pickup signal are directed through different branches simultaneously with the higher frequency components being directed through branches which provide greater lead of the output relative to the input. Such a composite network has a constant phase transfer function or relationship of difference to frequency regardless of the predominant frequency in the pickup signal. However, that constant phase transfer function is a curve varying towards greater drive signal lead for any component of the pickup signal as the frequency of that component increases. Also, a single-branched network having the same type of phase transfer function can be used instead of the plural-branched network and switching system. Yet another embodiment employs an analog shift register interposed between the pickup signal input and the drive signal output. The characteristics of the shift register may be controlled in response to the frequency content of the pickup signal to provide the desired relationship between frequency and phase difference of the drive signal relative to the pickup signal.

In the embodiments discussed above, the pickup signal is processed as an analog signal to provide the drive signal. However, analog processing can be replaced by appropriate digital processing. Thus, if the pickup signal may be converted to digital form, processed and reconverted to analog form to provide the drive signal. The digital signal processing employed may be arranged to simulate any of the analog arrangements discussed above, i.e., either to change the phase transfer function for all components in the pickup signal depending upon the frequency composition of the pickup signal or to process different components of the pickup signal so as to provide different leads to each component in a drive signal depending upon the frequency of that particular component. Either digital or analog signal processing may be performed by components mounted at locations other than on the instrument. Thus, the sustainer may incorporate signal processing equipment located off the instrument, free space communications equipment for sending the pickup signal to the processing equipment, further free space communications equipment for sending the processed signal back to the instrument, and a receiver on the instrument linked to the driver, as via an appropriate output amplifier, for receiving these processed signals and providing the drive signal. Such an arrangement can be used, for example, where the pickup signal is processed in fixed equipment such as digital processing equipment for recording or conversion to sound. The signal processing equipment in the sustainer can be integrated with the signal processing equipment used for recording. Provided that all of the components mounted on the instrument are powered by a self-contained power source such as battery 85, the sustainer will not impair the musician's freedom of movement.

The sustainer according to the present invention may be employed with a signal from pickups other than the inductive pickup discussed above. Thus, the pickup employed with the sustainer may be a capacitive sensor wherein the movement of the string alters the capacitance of a capacitor and change is detected to provide the pickup signal. Also, the pickup may be a photoelectric type having a photosensitive element such as a photoconductor or phototransistor juxtaposed with each string so that movement of the string will alter the amount of light impinging upon the photosensitive elements. Such a pickup may be employed either with ambient light or, preferably, with a source of light having a predetermined wavelength directed across the string to the photosensitive element and with a filter covering the photosensitive element so as to minimize influence of ambient light. Also, contact-type pickups such as piezo-electric, magnetostrictive, or resistance strain gauge types, having an active element mechanically linked to one or more of the strings may be employed. Likewise, the driver need not be an electromagnetic driver but may instead employ a piezo-electric element or the like. To the extent that these different pickups and/or drivers have phase transfer functions different from those of the electromagnetic pickups and drivers discussed above, the phase transfer function of the feedback means needed to optimize response of the strings in the fundamental mode to the drive forces applied by the sustainer may also differ. For example, a photoelectric pickup typically provides a pickup signal which, for practical purposes, is exactly in phase with the motion of the strings at all audio frequencies.

Figure 7:
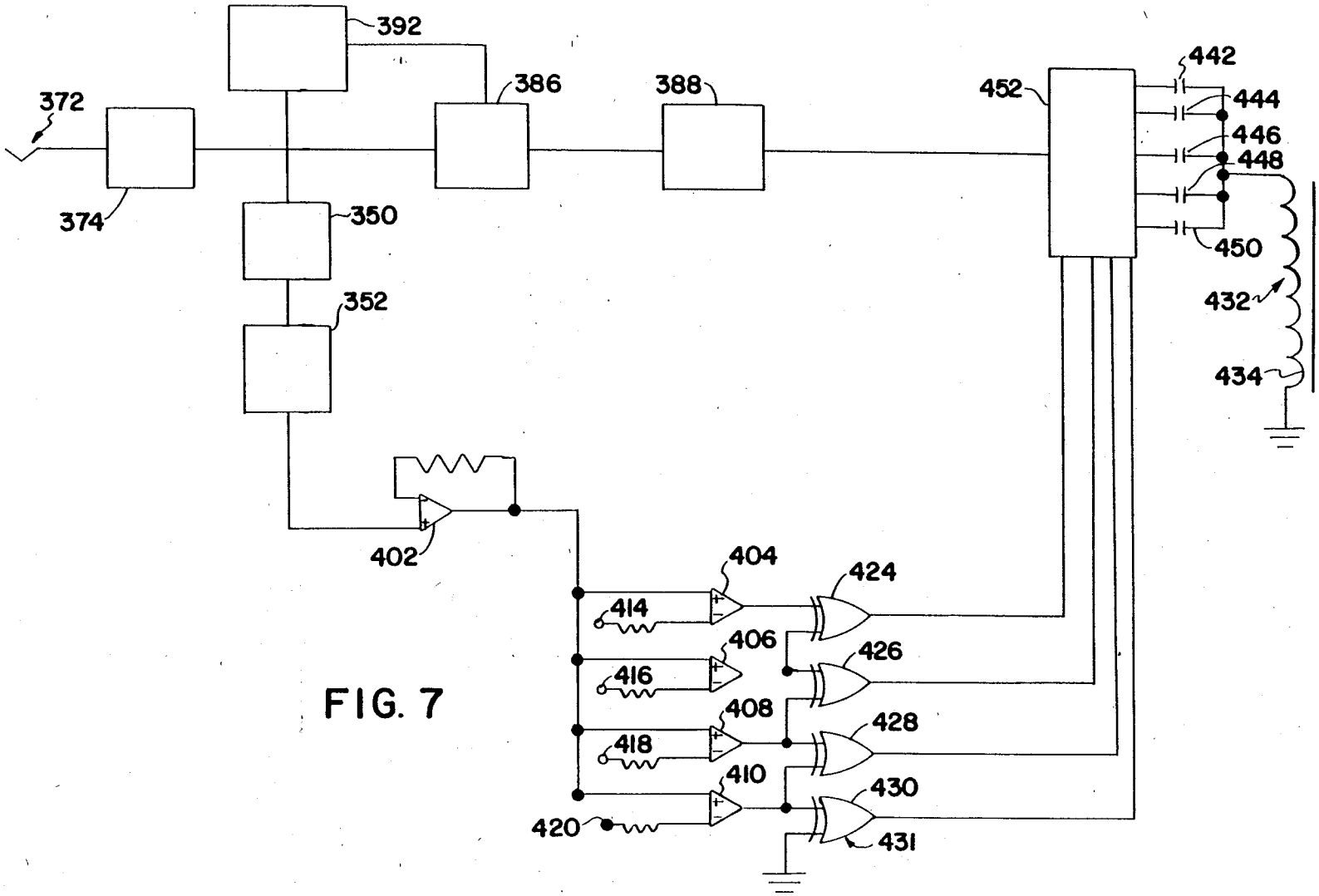
FIG. 7 is a fragmentary schematic circuit diagram depicting a portion of a sustainer according to a further embodiment of the invention.

A sustainer according to a further embodiment of the invention is schematically illustrated in FIG. 7. The sustainer according to this embodiment of the present invention incorporates an input connection 372 adapted to receive the pickup signal, a preamplifier 372 linked to the input connection, a signal detector 392 arranged to detect the signal level from preamplifier 374 and an on/off switch 386 controlled by signal detector 392. The feedback circuit is arranged to feed the signals from preamplifier 374 directly through on/off switch 386 to an output amplifier 388. These parts are similar to the corresponding parts of the embodiment discussed above with reference to FIGS. 1–6. Each component of the drive signal provided by output amplifier 388 is substantially in phase with the corresponding component of the pickup signal applied at input connection 372. The sustainer also includes a waveform squarer 350 connected to the output of preamplifier 374 and a frequency to voltage conversion circuit 352 connected to the output of waveform squarer 350. These parts are also similar to the corresponding parts of the embodiment of FIGS. 1–6. Thus, frequency to voltage conversion circuit 352 provides a signal voltage which varies directly with the frequency of the squared waveform provided by squarer 350 and hence varies directly with the predominant or greatest amplitude frequency in the pickup signal applied to input connection 372.

The output of frequency to voltage conversion circuit 352 is connected through an amplifier 402 to the positive inputs of each of four comparators 404, 406, 408 and 410. The negative input of each comparator is connected to a separate reference voltage source 414, 416, 418 and 420. Voltage sources 414–420 provide different, positive reference voltages, such that source 414, connected to comparator 404 provides the lowest voltage, source 416 connected to comparator 406 provides a somewhat higher voltage, source 418 provides a still higher voltage to comparator 408 and source 420 provides the highest reference voltage to comparator 410. Comparators 404–410 thus constitute an ordered array with comparator 404 constituting the first comparator in the array and comparator 410 constituting the last comparator. The outputs of comparators 404–410 are connected to the inputs of four exclusive OR or "XOR" gates 424, 426, 428 and 430. Gates 424–430 are also arranged in an ordered array, with gate 424 being the first gate and gate 430 being the last. Each gate 424–430 has a first input and a second input. The first input of each gate is connected to the output of the corresponding comparator 404–410 in the comparator array. The second input of each gate other than the last gate 430 is connected to the output of the next higher ordered comparator. For example, second gate 426 has a first input connected to the output of second comparator 406, whereas the second input of second gate 426 is connected to the output of third comparator 408. The second input of the last gate 430 is connected to ground.

The reference voltage sources, comparators and gates thus cooperatively constitute an analog to digital convertor 431. When the signal voltage provided by frequency to voltage convertor and amplifier 402 is less than the reference voltage provided by any of voltage sources 414–420, the outputs of all comparators will be negative and hence the outputs of all of gates 424–430 will be low or logical zero. When the signal voltage is greater than the voltage applied by the first voltage reference source 414, the output of first comparator 404 will be positive, whereas the outputs from all other comparators will remain negative. Thus, first XOR 424 gate will receive one positive input and one negative input, and hence will provide a high or logical one output. When the signal voltage provided by the frequency to voltage convertor and amplifier 402 exceeds the second reference voltage provided by source 416, the outputs both first comparator 404 and second comparator 406 will be positive, whereas the outputs of third and fourth comparators 418 and 420 will be negative. Therefore, the first XOR gate will receive two positive inputs and hence will provide a low or logical zero output, whereas the second XOR gate will receive one positive and one negative output and hence will provide a high or logical one output. In general, each XOR gate will provide a high or logical one output only when the signal voltage exceeds the reference voltage applied to the corresponding comparator but does not exceed the reference voltage applied to the next higher ordered comparator. The last XOR gate 430 will provide a high or logical one output whenever the signal voltage is higher than the highest reference voltage.

The drive means 432 utilized in this embodiment incorporates a coil 434 and permanently magnetized ferromagnetic element 436 similar to the coil and ferromagnetic element of the embodiment discussed above with reference to FIGS. 1–7. However, in this embodiment the drive means includes an array of capacitors 442, 444, 446, 448 and 450 all connected to one end of the coil 434. Capacitors 442–450 are arranged in an array from first to last with the first capacitor 450 having the highest capacitance value and the last capacitor 450 in the array having the lowest capacitance. Driver 432 is connected to output amplifier 388 through a digital logic controlled switching circuit 452 having control inputs linked to the output of analog to digital converter 431, i.e., to the outputs of XOR gates 424–430. Switching circuit 452 is arranged to route the drive signal from output amplifier 388 into driver 432 via one of capacitors 442–450 depending upon the output of analog to digital converter 431. Thus, where none of the XOR gates provide a high or logical one output, switching circuit 452 will route the drive signal into the drive means via the first capacitor 442. When first XOR gate 424 provides a logical one output, switching circuit 452 routes the signal trough second capacitor 444, and so on. Thus, switching circuit 452 will effectively enable and disable the capacitors of drive means 432 depending upon the signals received from analog to digital converter 431.

In operation, waveform squarer 350, frequency to voltage converter 352 and amplifier 402 cooperate to provide a signal voltage which increases directly with the predominant frequency of the pickup signal. Where the predominant frequency in the pickup signal is low, first capacitor 442 will be enabled, whereas capacitors 444–450 will all be disabled. As the predominant frequency in the pickup signal increases, first capacitor 442 will be disabled, and second capacitor 444 will be enabled. For progressively higher predominant frequencies, progressively higher ordered capacitors 446, 448 and 450 will be enabled and disabled in sequence so that only one capacitor is enabled at any given time. Thus, when the predominant frequency of the pickup signal is low, the capacitance of drive 432 will be high At progressively higher predominant frequency values, the capacitance of the driver will decrease as progressively higher ordered, lower-value capacitors are enabled. As the capacitance of driver 432 changes, the phase transfer function of the drive means (the relationship between the applied signal voltage or drive signal provided by amplifier 388 and the electromagnetic forces applied by the driver to the strings) also changes. Thus, as the capacitance of the driver decreases, the component of the drive force at a given frequency will have less lag (or more lead) with respect to the corresponding component in the drive signal. Notably, the phase transfer function of the feedback means remains the same, but the phase transfer function of the drive means changes depending upon the predominant frequency in the pickup signal. However, the overall effect is substantially the same as that achieved by the variable lead network employed in the embodiment discussed above with reference to FIGS. 1–6. Thus, in the embodiment of FIG. 7 the composite phase transfer function of the feedback means and the drive means changes in the direction of increasing drive force lead (or away from drive force lag) relative to the pickup signal as the predominant frequency increases.

The sustainer may incorporate a pickup rather than a connection to a separate pickup. In this case, the sustainer may include means for adjusting the phase transfer function of the pickup so as to alter the composite phase transfer function of the entire sustainer. For example, the capacitance of an electromagnetic pickup can be adjusted in substantially the same way as the capacitance of the driver is adjusted in the embodiment of FIG. 7. Any of these approaches, or any combination thereof, can be used to adjust the phase transfer function of the sustainer as a whole—the relationship between frequency and phase difference of the drive force relative to string motion—as the frequency content of the pickup signal changes.

Figure 8:
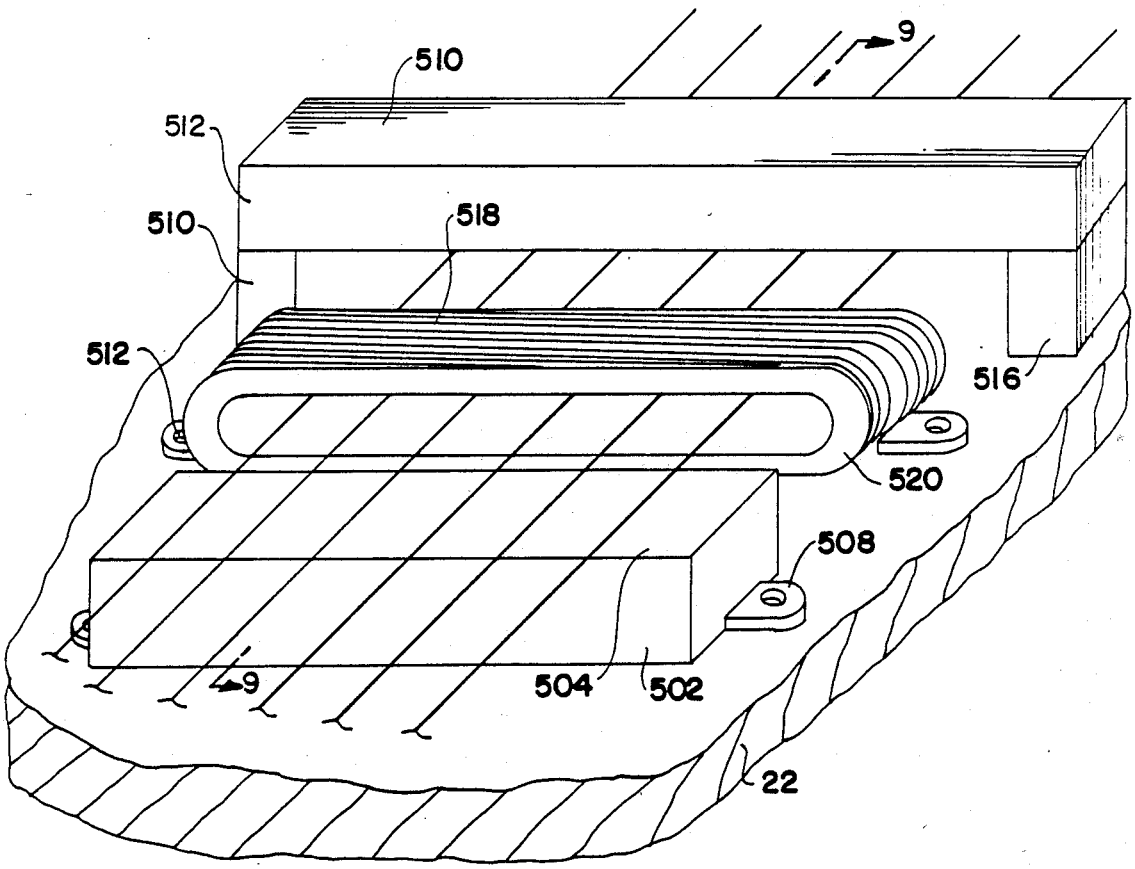
FIG. 8 is a schematic, fragmentary perspective view depicting a portion of a sustainer in accordance with another alternate embodiment of the invention.
Figure 9:
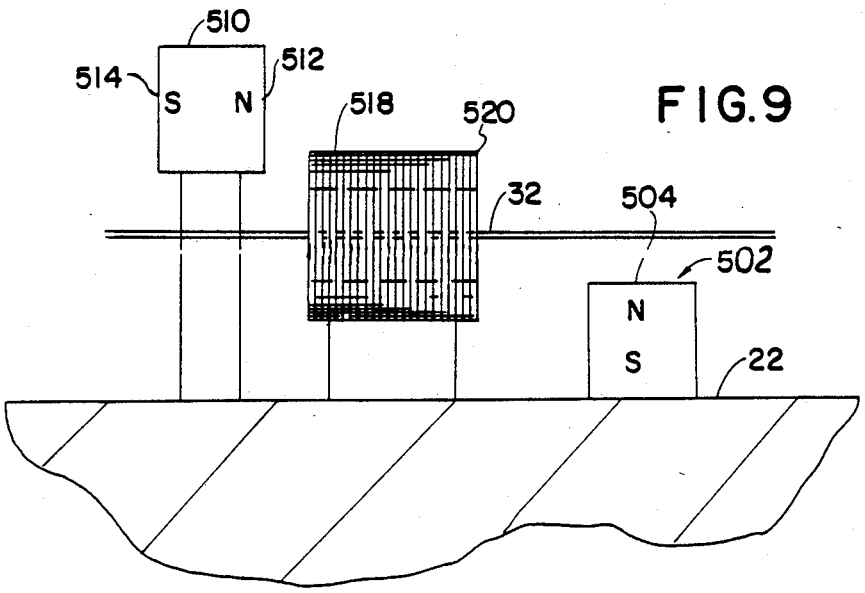
FIG. 9 is a fragmentary, schematic sectional view taken along lines 9—9 in FIG. 8.

A driver in accordance with yet another embodiment of the present invention is shown in FIGS. 8 and 9. This driver includes a first bar-like permanently magnetized ferromagnetic element 502 having a north-seeking pole at a first long face 504 and a south-seeking pole adjacent an opposite face 506. Means such as screws or clips 508 are provided for mounting element 502 to the structure of the guitar, such as to the body 22, so that the ferromagnetic element is positioned beneath the strings 32. Thus, element 32 lies between the strings and the guitar body with polar face 502 facing upwardly, towards the strings. A second barlike, permanently magnetized ferromagnetic element has a north-seeking pole along one face 512 and a south-seeking pole along another face 514. Means such as columnar supports or "standoffs" 516 are provided for mounting second ferromagnetic element 510 to the guitar body so that the ferromagnetic element is disposed above the strings, rearwardly of the first ferromagnetic element 502. Thus, element 510 is positioned closer to the headstock of the guitar, whereas element 502 is positioned closer to the bridge of the guitar. The mounting means associated with element 510 are arranged to hold this barlike element so that its pole faces extend in the lengthwise direction of the string array with north-seeking face 512, facing forwardly towards the bridge of the guitar and towards element 502. The mounting means thus hold the ferromagnetic elements on opposite sides of the strings 32 and spaced from one another in the lengthwise direction of the string array.

A helical coil 518 is wound on a hollow coil support or bobbin 520. The coil support, and hence the coil, are generally in the form of a hollow tube of rectangular cross section, with the long dimension of the interior opening of the tube being slightly larger than the widthwise dimension of the array of strings 32. Coil support 520 and coil 518 are secured to the instrument by mounting means 522 such as screws, clips or the like so that coil 518 encircles strings 32 at a location along the lengthwise extent of the string array between ferromagnetic elements 510 and 502, with the axis of the coil extending lengthwise along the string array. In operation a drive signal or voltage is applied to coil 518 by feedback means as discussed above so that the coil produces magnetic flux. This flux interacts with strings 32 together with flux from ferromagnetic elements 502 and 510. Here again, the interaction of the magnetic flux from coil 518 with strings 32 is substantially uniform over the entire widthwise range of motion of each string 32. Accordingly, the driving action is substantially unaffected by lateral bending of the strings.

Figure 10:
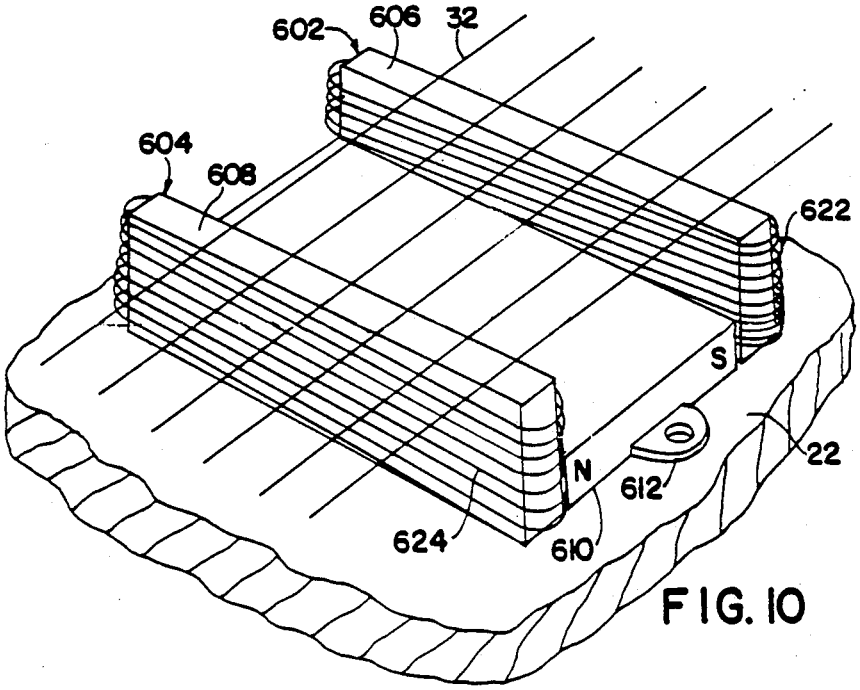
FIG. 10 is a fragmentary perspective view similar to FIG. 8 but depicting a sustainer in accordance with another embodiment of the invention.

A driver in accordance with yet another embodiment of the present invention, as shown in FIG. 10, includes 2 elongated, slab-like ferromagnetic elements 602 and 604, having top edge surfaces 606 and 608 respectively. The top surfaces 606 and 608 are curved to match the curvature of the imaginary surface defined by the strings 32. Thus, when the driver is mounted to the instrument in the operative position illustrated, top surfaces 606 and 608 each extend substantially parallel to the imaginary surface defined by the strings. Elements 602 and 604 are ferromagnetic, but are not themselves permanent magnets. A slab-like permanent magnet 610 extends between the lower edges of elements 602 and 604, so that element 602 and 602 together with the permanent magnet cooperatively form a U-shaped channel. Mounting means such as fasteners 612 are provided for mounting this entire channel to the guitar structure, as to the body 22, so that the U-shaped channel extends generally laterally with respect to the string array. Permanent magnet 610 has its north-seeking pole along the edge of the magnet adjacent ferromagnetic element 504, and its south-seeking pole along the opposite edge, adjacent element 602. Accordingly, flux from permanent magnet 610 will pass upwardly through element 604 and through its top surface 608, through the imaginary surface defined by the strings and back downwardly through element 602, via the top surface 606 of this element.

A coil 622 is wound around element 602, whereas a coil 624 having the same number of turns is wound in the opposite direction on element 604. These two coils are connected in parallel. The connection is arranged so that a voltage of one polarity applied across the parallel connected coils will produce and upwardly directed flux from coil 624 and a downwardly directed flux from coil 622, thus reinforcing the flux in both ferromagnetic elements, whereas a voltage of the opposite polarity will produce the opposite effect, thus counteracting the flux in both ferromagnetic elements.

Figure 1:
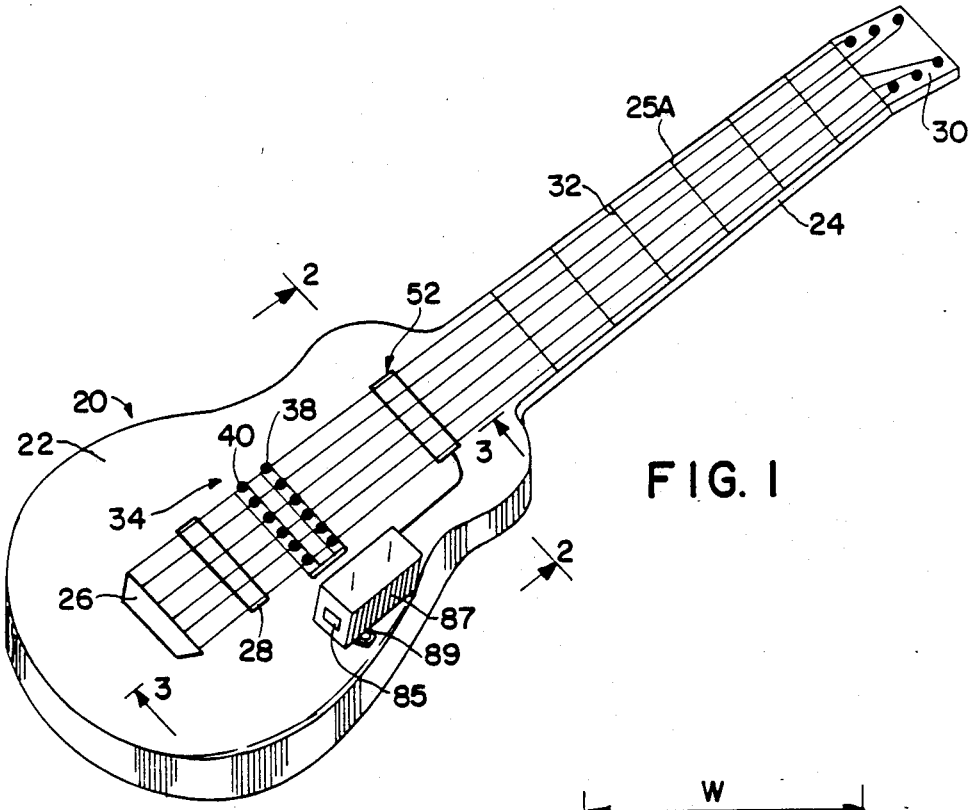
FIG. 1 is a schematic perspective view of a sustainer in accordance with one embodiment of the present invention, in conjunction with a musical instrument.

A driver according to this embodiment of the present invention provides advantages similar to those of the driver depicted in FIGS. 1-3. The magnetic flux from the driver of FIG. 10 is substantially uniform across the entire lateral extent of the string array, and hence the sustainer action is not adversely affected by lateral bending of the strings. The driver of FIG. 10 moreover provides substantially stronger magnetic interaction for a given current flow. Each coil 622 and 624 may incorporate more turns than would be employed in the coil of a single coil driver. The magnetic flux imparted by the two coils reinforce one another. The net effect is to provide a substantially greater magnetic effect, and hence a substantially greater vibration sustaining effect with the same power dissipation. The driver depicted in FIG. 10 can also be used as a pickup. Where the pickup is connected to a high impedance device such as preamplifier 74 (FIG. 4) the two coils 622 and 624 desirably are connected in series rather than in parallel.

In a variant of the driver illustrated in FIG. 10, the entire U-shaped channel is permanently magnetized. In a further variant, permanent magnet 610 is omitted, and each of ferromagnetic elements 602 and 604 is permanently magnetized. The magnetization in these two separate elements should be such as to provide the same flux directions as discussed above viz., upwardly from the top surface 608 of element 604 and downwardly into the top surface 606 of element 602. Thus, the north-seeking pole of element 604 would lie along the top surface, whereas the south-seeking pole of element 602 would be disposed along the top surface. Also, the flux directions of both elements could be reversed.

APPENDIX

Component values useful in one example of variable lead circuit 82 (FIG. 5) are as follows:

| RESISTOR | RESISTANCE (OHMS; K = KILO M = MEGA) |
|---|---|
| 132 | 10K |
| 136 | 10K |
| 142 | 2.2 M |
| 159 | 100K |
| 160 | 47 |
| 174 | 47K |
| 176 | 5.1K |
| 178 | 10K |
| 182 | 10K |
| 186 | 10K |
| 190 | 15K |
| 194 | 100K |
| 195 | 220K |
| 202 | 100K |
| 206 | 100K |
| 208 | 200K |
| 210 | 200K |
| 214 | 20K |
| 218 | 10K |
| 220 | 20K |
| 222 | 33K |
| 226 | 33K |
| 232 | 12K |
| 234 | 100K |
| 238 | 82K |
| 242 | 25K |
| 243 | 25K |
| 244 | 25K |
| 247 | 10K |
| **CAPACITORS** | **CAPACITANCE (MICROFARAD)** |
| 138 | .0082 |
| 180 | .01 |
| 184 | .022 |
| 196 | .47 |
| **FET** | **TYPE** |
| 144 | VCR7N |

As numerous other variations and combinations of the features described above can be utilized without departing from the present invention as defined by the claims, the foregoing description of the preferred embodiments should be taken by way of illustration rather than by way of limitation of the present invention.

What is claimed is:

1. A sustainer for a musical instrument having a vibratory element comprising:

(a) drive means responsive to a drive signal for applying a drive force to a vibratory element of said instrument so that said drive force has a predetermined phase relationship to said drive signal; and (b) feedback means for accepting a pickup signal representing vibration of a vibratory element of said instrument and having a predetermined phase relationship to said vibration and providing said drive signal to said drive means so that said drive force is substantially in phase with vibration of said vibratory element.

2. A sustainer as claimed in claim 1 further comprising pickup means for producing said pickup signal responsive to vibration of the vibratory element of the instrument and providing said pickup signal to said feedback means.

3. A sustainer as claimed in claim 2 wherein at least one of said pickup means and said drive means has a non-zero phase transfer function and wherein said feedback means has a phase transfer function substantially inverse to the combined phase transfer function of said pickup means and said drive means.

4. A sustainer as claimed in claim 1 or claim 3 further comprising self-contained power supply means and means for mounting said power supply means to the instrument, said feedback means including means for providing power in said drive signal from said power supply means.

5. A sustainer for a musical instrument having a vibratory element, said sustainer comprising feedback means for accepting a pickup signal representing vibration of the vibratory element of the instrument and converting said pickup signal to a drive signal so that for at least some frequencies of said pickup signal said drive signal differs in phase from said pickup signal and said phase difference varies with frequency, such variation being towards a drive signal leading phase difference with increasing frequency, and drive means for applying a drive force to the vibratory element of the instrument responsive to said drive signal.

6. A sustainer as claimed in claim 5 wherein said drive means is operative to apply said drive force to the vibratory element of the instrument so that said drive force lags said drive signal for said at least some frequencies.

7. A sustainer as claimed in claim 6, further comprising pickup means for producing a pickup signal responsive to vibration of the vibratory element of the instrument.

8. A sustainer as claimed in claim 7 wherein, for at least some frequency said feedback means is operative to provide lead in said drive signal relative to said pickup signal.

9. A sustainer as claimed in claim 8 further comprising self-contained power supply means and means for mounting said power supply means to the instrument, said feedback means including means for providing power in said drive signal from said power supply.

10. A sustainer as claimed in claim 6 wherein said drive means includes an inductive drive coil and means for applying said drive force to the vibratory element of the instrument responsive to magnetic flux in said coil, and said feedback means includes means for applying said drive signal as a voltage across said coil.

11. A sustainer as claimed in claim 10 wherein said means for applying said drive force responsive to said flux includes means for mounting said coil to the instrument so that magnetic flux from said coil will impinge upon the vibratory element of the instrument.

12. A sustainer as claimed in claim 11 wherein said mounting means includes means for mounting said drive coil to an instrument having at least one string as a vibratory element so that said drive coil is juxtaposed with said a least one string.

13. A sustainer as claimed in claim 12 wherein said means for mounting said drive coil to the instrument includes means for mounting said drive coil to an instrument having a plurality of strings, and said means for applying said drive force includes means for directing flux from said coil to all of said plurality of strings.

14. A musical instrument comprising a sustainer as claimed in claim 13, a structure, a plurality of strings mounted to said structure, and pickup means for detecting vibratory motion of said strings and providing said pickup signal to said feedback means.

15. A sustainer for a musical instrument having a vibratory element, said sustainer comprising feedback means for accepting a pickup signal representing vibration of at least one vibratory element of the instrument and converting said pickup signal to a drive signal, drive means for applying a drive force to the vibratory element of the instrument responsive to said drive signal and control means for determining the frequency content of said pickup signal and altering the phase transfer function of the sustainer depending on said frequency content.

16. A sustainer as claimed in claim 15 wherein said control means includes means for detecting a predominant frequency in said pickup signal having the greatest amplitude and providing a signal representing said predominant frequency and means for adjusting the phase transfer function of at least one of said feedback means and said drive means in response to said signal representing said predominant frequency.

17. A sustainer as claimed in claim 16 wherein said drive means includes means for applying said drive force to a plurality of vibratory elements whereby when said pickup signal includes signals representing vibration of a plurality of vibratory elements, all vibrating at different frequencies, said sustainer will selectively reinforce the vibration of the vibratory element having the greatest amplitude.

18. A sustainer as claimed in claim 16 wherein said control means includes means for adjusting the phase transfer function of said feedback means in response to said signal representing said predominant frequency.

19. A sustainer as claimed in claim 18 wherein said feedback means includes an input connection for receiving said pickup signal, an output connection for delivering said drive signal and a network having a pickup signal infeed node connected to said input, an operational amplifier having inverting and noninverting inputs and an output connected to said output connection, a resistor connected between said pickup signal infeed node and one said input of said operational amplifier, a capacitor having a first side connected to said pickup signal infeed node and a second side connected to the other one of said operational amplifier inputs, and a variable value resistance element connected between said second side of said capacitor and ground, said means for adjusting said phase transfer function of said feedback means including means for varying the resistance of said variable resistance element inversely to the predominant frequency of said pickup signal.

20. A sustainer as claimed in claim 16 wherein said control means includes means for adjusting the phase transfer function of said drive means in response to said signal representing said predominant frequency.

21. A sustainer as claimed in claim 1 or claim 5 or claim 15 further comprising alternate signal means for providing said drive signal responsive to said pickup signal, the phase transfer function of said alternate signal means being different from the phase transfer function of said feedback means, and selector means for selectively actuating either said feedback means or said alternate signal means.

22. A sustainer as claimed in claim 21 wherein said alternate signal means includes lag network means for providing said drive signal so that said drive signal lags said pickup signal and said lag increases with frequency.

23. A sustainer as claimed in claim 22 wherein said alternate signal means further includes straight-through means for providing said drive signal in phase with said pickup signal, said selector means including means for selectively actuating either said lag network means or said straight-through means.

24. A sustainer as claimed in claim 1 or claim 5 or claim 15 further comprising automatic gain control means for controlling said feedback means to maintain said drive signal at a predetermined magnitude, and means for adjusting said automatic gain control means to alter said predetermined magnitude.

25. A sustainer as claimed in claim 24 wherein said feedback means includes an output amplifier for producing said drive signal and means defining a signal path leading to said output amplifier, said automatic gain control means including a variable impedence connected in said signal path and means for controlling said variable impedence responsive to the magnitude of said drive signal.

26. A sustainer for a musical instrument of the type having a plurality of strings extending in generally a lengthwise direction and disposed side-by-side so as to define an array extending in lateral directions transverse to said lengthwise direction, said sustainer comprising:

(a) means for providing a drive signal; and (b) drive means responsive to said drive signal for applying drive forces to the strings of the instrument at a drive location remote from the ends of the strings so that the drive force applied to each said string is substantially independent of lateral displacement of such string.

27. A sustainer as claimed in claim 26 wherein said drive means includes means for providing a magnetic field varying in accordance with said drive signal so that said varying magnetic field is substantially uniform throughout the lateral range of motion of each string of the instrument at said drive location.

28. A sustainer as claimed in claim 27, wherein said means for providing a varying magnetic field includes a ferromagnetic element, means for directing magnetic flux through said ferromagnetic element, and means for mounting said ferromagnetic element to the instrument so that said ferromagnetic element extends laterally across the entire width of said array in proximity to said strings.

29. A sustainer as claimed in claim 28 wherein said means for providing said varying magnetic field includes a coil juxtaposed with said ferromagnetic element.

30. A sustainer as claimed in claim 29 wherein said coil encircles said ferromagnetic element.

31. A sustainer as claimed in claim 30 herein said ferromagnetic element includes a permanent magnet.

32. A sustainer as claimed in claim 30 wherein said means for providing a varying magnetic field includes a second ferromagnetic element and a second coil encircling said second ferromagnetic element said mounting means including means for mounting said second ferromagnetic element to the instrument so that said second ferromagnetic element extends laterally across said array in proximity to said strings, said second coil being wound in the opposite direction from the first said coil.

33. An instrument comprising a body, a plurality of strings mounted to said body, a sustainer as claimed in claim 31, said permanent magnet of said sustainer being mounted to said body, and a pickup incorporating a permanent magnet mounted to said body, said permanent magnets being mounted to said body so that flux from said permanent magnet of said driver is codirectional with flux from the closest portion of said permanent magnet of said pickup.

34. A sustainer as claimed in claim 29 wherein said means for mounting said ferromagnetic element includes means for mounting said ferromagnetic element to the instrument so that a surface of said ferromagnetic element faces said strings and extends substantially parallel to the imaginary surface defined by said strings when said strings are in an undisturbed condition.

35. A sustainer as claimed in claim 27 wherein said means for providing a varying magnetic field includes a coil and means for mounting said coil to the instrument so that said coil encircles said strings.

36. A sustainer as claimed in claim 35 further comprising two ferromagnetic elements, at least one of said ferromagnetic elements including a permanent magnet, and means for mounting both said ferromagnetic elements to the instrument so that said ferromagnetic elements are jutaposed with one another above and below said strings and said ferromagnetic elements are spaced apart from one another in the lengthwise direction of said strings, said means for mounting said coil including means for mounting said coil between said ferromagnetic elements.

* * * * *

UNITED STATES PATENT AND TRADEMARK OFFICE

CERTIFICATE OF CORRECTION

PATENT NO. : 4,907,483

DATED : March 13, 1990

INVENTOR(S) : Floyd D. Rose, et al.

It is certified that error appears in the above-identified patent and that said Letters Patent is hereby corrected as shown below:

Column 1, line 12, "provide" should read --provided--.
Column 1, line 51, "tringed" should read --stringed--.
Column 2, line 27, "excited" should read --excite--.
Column 2, line 59, "s" should read --so--.
Column 3, line 58, "i" should read --in--.
Column 4, line 25, "he" should read --the--.
Column 4, line 33, "come" should read --compensates--.

Column 4, line 54, "response" should read --responsive--.
Column 5, line 56, after "variables associated" should read --with--.
Column 6, line 61, "n" should read --in--.
Column 8, line 55, "774" should read --74--.
Column 8, line 59, "t" should read --to--.
Column 10, line 34, "mode" should read --node--.
Column 10, line 42, "13" should read --134--.
Column 11, line 15, "115" should read --152--.
Column 11, line 33, "14" should read --174--.
Column 11, line 65, "30" should read --230--.
Column 12, line 2, "ne" should read --one--.
Column 15, line 3, "of" should read --for--.
Column 15, line 5, "2" should read --32--.
Column 15, line 9, "force" should read --forces--.

UNITED STATES PATENT AND TRADEMARK OFFICE

CERTIFICATE OF CORRECTION

PATENT NO. : 4,907,483

DATED : March 13, 1990

INVENTOR(S) : Floyd D. Rose, et al.

It is certified that error appears in the above-identified patent and that said Letters Patent is hereby corrected as shown below:

Column 16, line 55, "sting" should read --string--.
Column 23, line 35, "504" should read --604--.
Column 26, line 5, "a" should read --at--.
Column 28, line 12, "herein" should read --wherein--.

Signed and Sealed this

Ninth Day of June, 1992

*Attest:*

*Attesting Officer*

DOUGLAS B. COMER

*Acting Commissioner of Patents and Trademarks*